US007430114B2

(12) United States Patent
Rouleau et al.

(10) Patent No.: US 7,430,114 B2
(45) Date of Patent: Sep. 30, 2008

(54) DUAL USE COMPUTER DESK

(76) Inventors: Pamela Sue Rouleau, 735 County Rd. 3336, Paradise, TX (US) 76073; David Ernest Rouleau, 735 County Rd. 3336, Paradise, TX (US) 76073

( * ) Notice: Subject to any disclaimer, the term of this patent is extended or adjusted under 35 U.S.C. 154(b) by 213 days.

(21) Appl. No.: 11/207,498

(22) Filed: Aug. 19, 2005

(65) Prior Publication Data

US 2007/0041152 A1 Feb. 22, 2007

(51) Int. Cl.
*A47B 17/00* (2006.01)
*G06F 1/16* (2006.01)
*H05K 5/00* (2006.01)

(52) U.S. Cl. ..... 361/683; 361/681; 108/50.01; 312/196

(58) Field of Classification Search ..... 312/196, 312/208.1, 223.3, 290, 198, 9.51, 223.6; 108/50.01, 94; 361/683, 679–682, 685, 724, 361/726–727, 608, 616
See application file for complete search history.

(56) References Cited

U.S. PATENT DOCUMENTS

| | | | | | |
|---|---|---|---|---|---|
| 4,561,619 | A | * | 12/1985 | Robillard et al. | 248/285.1 |
| 4,648,574 | A | * | 3/1987 | Granlund | 248/349.1 |
| 4,766,422 | A | * | 8/1988 | Wolters et al. | 312/198 |
| 5,287,815 | A | | 2/1994 | Gross | 108/50 |
| 5,666,264 | A | | 9/1997 | Chandler et al. | 361/683 |
| 5,685,231 | A | | 11/1997 | Eyre | 108/7 |
| 5,738,422 | A | | 4/1998 | Welborne, Jr. et al. | 312/198 |
| 5,791,259 | A | * | 8/1998 | Mansfield et al. | 108/6 |
| 6,099,093 | A | * | 8/2000 | Spence | 312/196 |
| 6,135,032 | A | | 10/2000 | Ko | 108/96 |
| 6,170,410 | B1 | * | 1/2001 | Gioacchini et al. | 108/153.1 |
| 6,193,338 | B1 | | 2/2001 | Kocer | 312/194 |
| 6,283,564 | B1 | * | 9/2001 | Corson | 312/223.2 |
| 6,508,525 | B2 | * | 1/2003 | Picogna | 312/196 |
| 6,769,369 | B1 | * | 8/2004 | Brandenberg | 108/158.12 |
| 6,857,712 | B1 | * | 2/2005 | Haberman | 312/223.3 |
| 6,935,247 | B2 | * | 8/2005 | Schaefers et al. | 108/50.01 |
| 2003/0020381 | A1 | * | 1/2003 | Cattaneo | 312/223.6 |
| 2003/0076014 | A1 | * | 4/2003 | Kelley et al. | 312/194 |
| 2003/0184194 | A1 | * | 10/2003 | Probst | 312/223.3 |
| 2004/0254020 | A1 | * | 12/2004 | Dragusin | 463/46 |
| 2005/0288104 | A1 | * | 12/2005 | Walsh | 463/46 |

* cited by examiner

*Primary Examiner*—Jayprakash N Gandhi
*Assistant Examiner*—Bradley H Thomas
(74) *Attorney, Agent, or Firm*—Guy V. Manning

(57) ABSTRACT

A dual use computer desk has a planar work surface supported by side panels at opposite longitudinal ends of a curvilinear front edge. Bifurcating into two work stations the space under the desk top, a cabinet contains sliding shelves for a computer and other equipment and accessories. Slidable drawers disposed at a spaced distance below the desktop within each of the work stations provide adjustable storage for computer controller equipment. At one of the work stations, gaming equipment may be attached and ready for use, while the other work station may contain a keyboard and mouse for more conventional computer functions. A swivel stand disposed on the desktop above the cabinet allows a monitor to articulate between the two work stations.

18 Claims, 4 Drawing Sheets

DUAL USE COMPUTER DESK

BACKGROUND OF THE INVENTION

1. Field of the Invention

This invention relates generally to computer furniture and particularly to computer desks serving as dedicated work stations for desktop computers and game machines. More particularly, this invention relates to a dual station desk having a swivel monitor deck which reciprocates between a keyboard station and a game controller station, both of which utilize a common computer located between them.

2. Description of Related Art

Specialized computer furniture is commonplace in the art. Most computer desks have a substantial desktop at a normal, thirty (30") inch work surface height and sliding drawers or shelves beneath to hold a keyboard and mouse at a more ergonomic level for a user seated at the desk. Others lower the whole desktop surface so the workspace itself is at a comfortable keyboard height. The typical computer desk includes spaces for the computer CPU cabinet either on or beneath the work surface, and a hutch or other shelving atop the desk for a monitor and other accessories.

Computers increasingly are used for both gaming and business activities, but seldom at the same time. Gaming comprises operating software which manipulates game images on a monitor, commonly with specialized game controllers that either substitute for or supplement the keyboard and mouse. Game controllers may comprise simple joy sticks or small, hand-held devices with buttons, but some comprise large, elaborate stations which clamp to a desktop and include wheels, foot pedals and the like for simulating driving, flying or other cockpit experiences. Such elaborate game controllers are inconvenient to remove when conventional keyboard and mouse use is contemplated. A need exists for a computer desk adapted to accommodate the dual uses of substantially permanent game controllers and keyboard and mouse stations.

SUMMARY OF THE INVENTION

Accordingly, it is an object of this invention to provide a dual use computer desk having two independent stations which employ a single computer and monitor.

It is another object of this invention to provide a computer desk which allows easy switching between computer gaming activities using an elaborate game controller and business or other uses which rely on a conventional keyboard and mouse.

It is another object of this invention to provide a dual purpose computer desk with two work stations sharing a single computer and monitor.

It is yet another object of this invention to provide a dual use computer desk which stores equipment for both gaming and business activities.

The foregoing and other objects of this invention are achieved by providing a dual use computer desk having a planar work surface supported by side panels at opposite longitudinal ends of a curvilinear front edge. Bifurcating into two work stations the space under the desk top, a cabinet contains sliding trays for a computer and other equipment and accessories. Slidable drawers disposed a spaced distance below the desktop within each of the work stations provide adjustable storage for computer controller equipment. At one of the work stations, gaming equipment may be attached and ready for use, while the other work station may contain a keyboard and mouse for more conventional computer functions. A swivel stand disposed on the desktop above the cabinet allows a monitor to articulate between the two work stations.

BRIEF DESCRIPTION OF THE DRAWINGS

The novel features believed characteristic of the present invention are set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
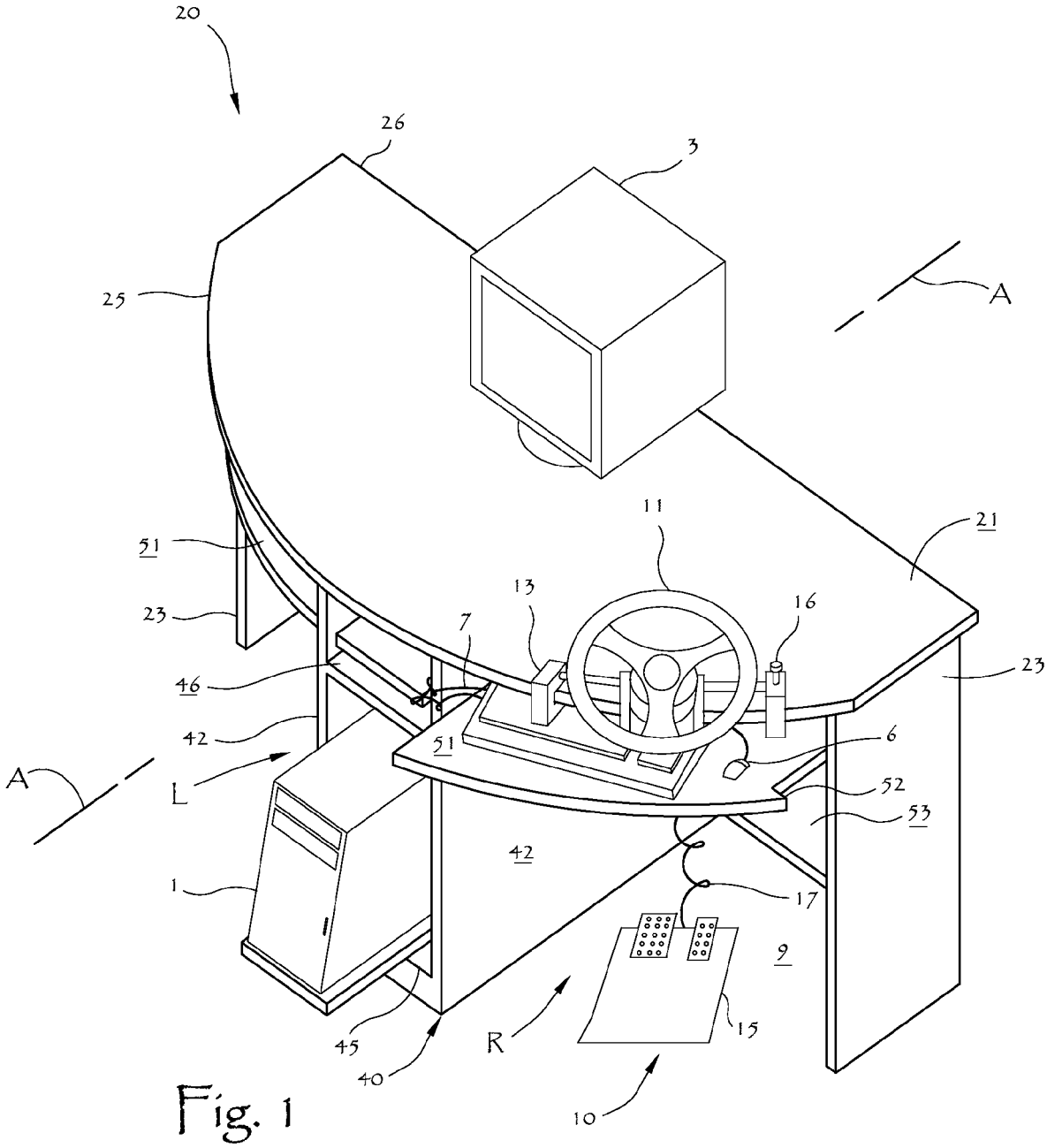
FIG. 1 depicts in right quartering perspective a preferred embodiment of the dual use computer desk of the present invention.
Figure 2A:
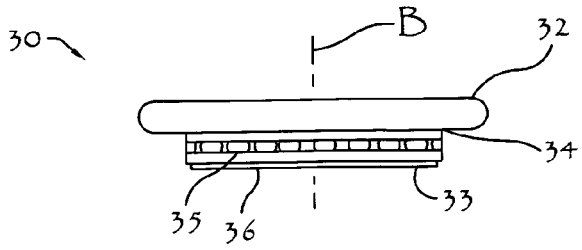
FIG. 2A details a monitor swivel adjunct to the desk of FIG. 1.
Figure 2:
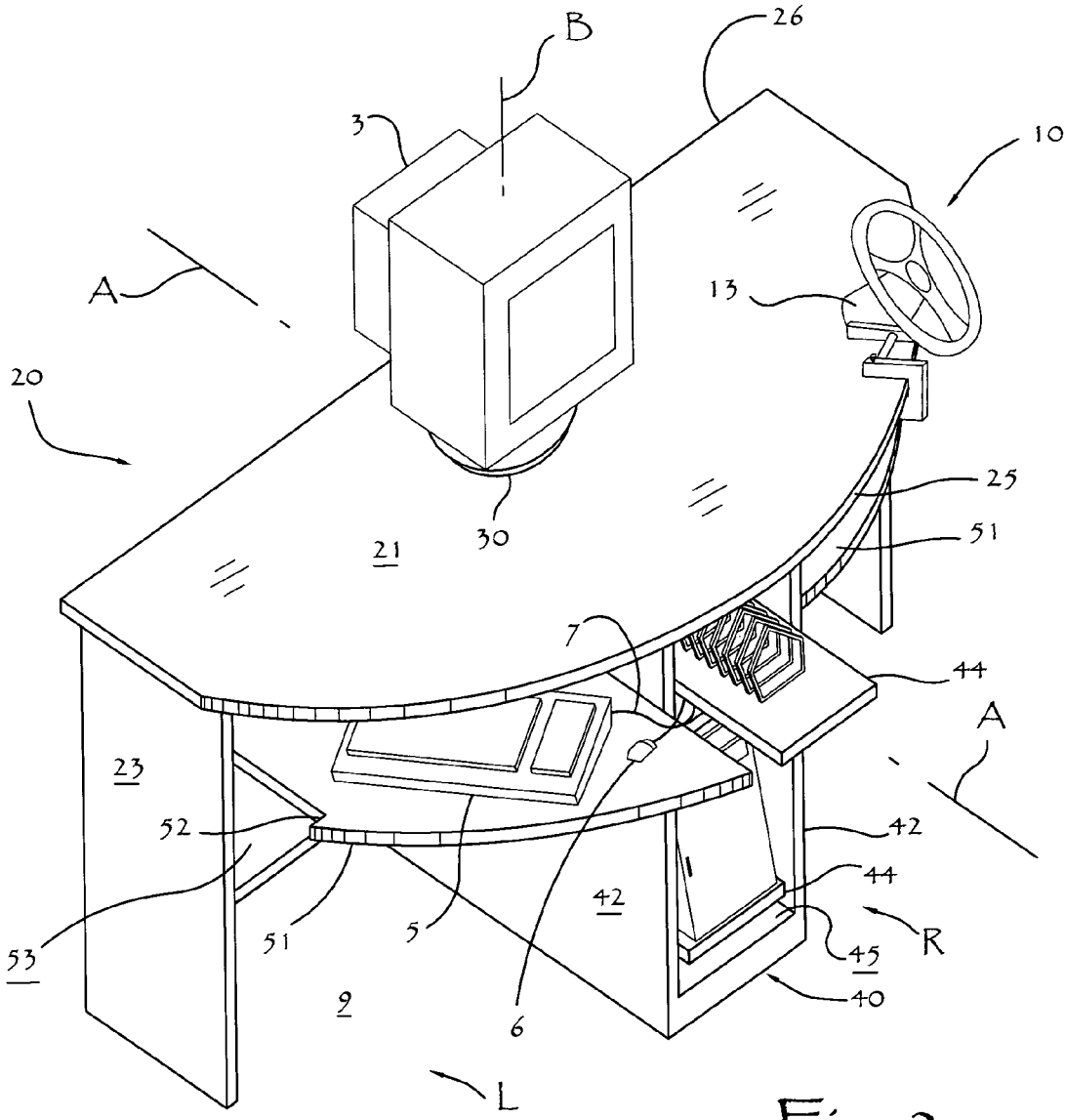
FIG. 2 shows the present invention of FIG. 1 in a left quartering perspective view.
Figure 3:
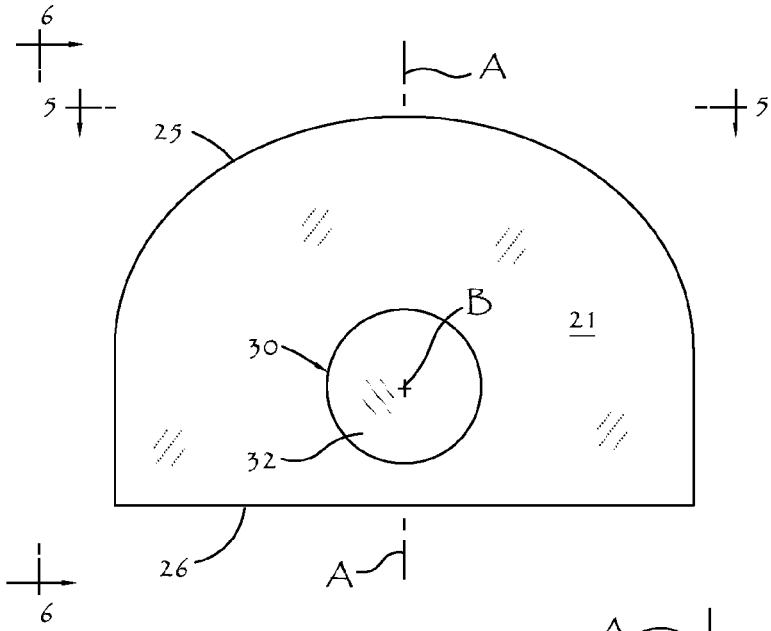
FIG. 3 shows a top plan view of the desk of FIG. 1.
Figure 4:
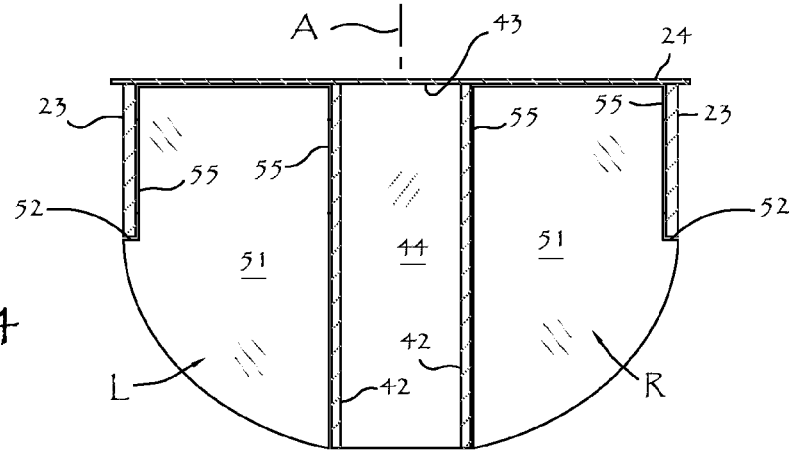
FIG. 4 shows a cross sectional top plan view of the desk of FIG. 1 as indicated in FIG. 5.
Figure 5:
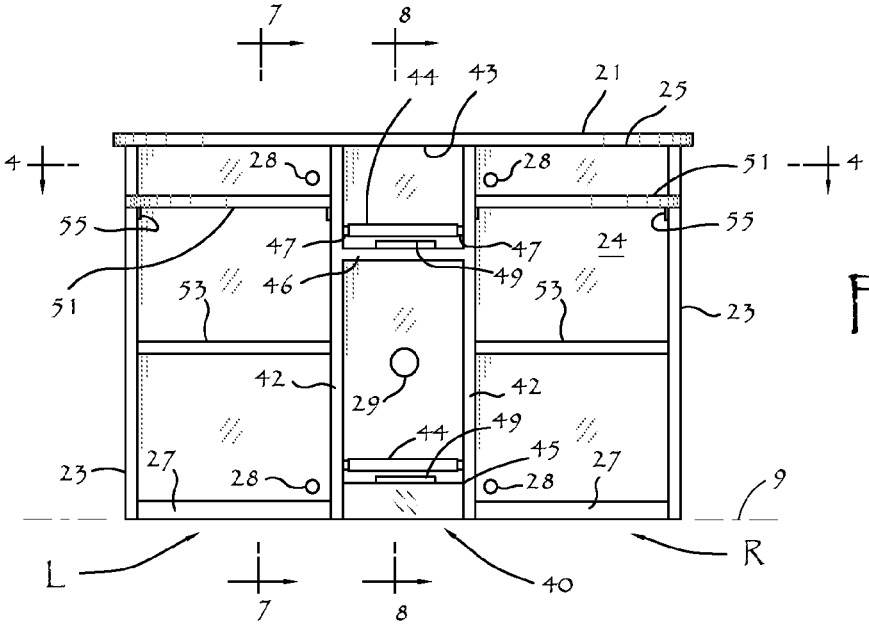
FIG. 5 shows a front elevational view of the desk of FIG. 1.
Figure 6:
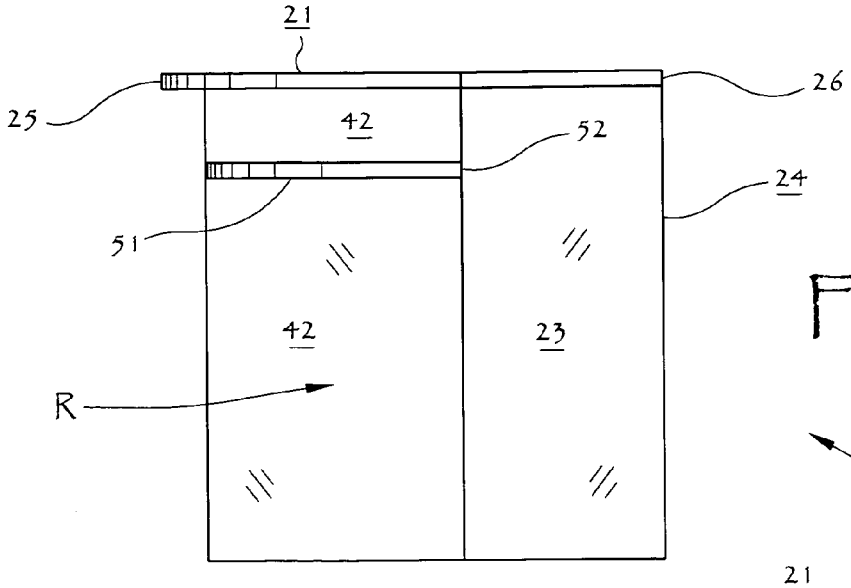
FIG. 6 shows a right side elevational view of the desk of FIG. 1.

With reference now to the figures, and in particular to FIGS. 1, 2 and 5, computer desk 20, adapted to rest upon a floor 9 or other platform, includes planar desktop and work surface 21 substantially parallel to the floor 9 and having a straight, longitudinal back edge 26 opposite a curvilinear front edge 25. Desktop 21 is supported above floor 9 at its longitudinal ends by end panels 23, longitudinally at its rear by back 24 (see also FIG. 4) and across its center astraddle transverse axis A by cabinet 40. Preferably, desktop 21 is disposed at the height above floor 9, typically thirty (30") inches, of conventional desks and tables which contemplates a user (not shown) seated in a chair at front edge 25, with his feet and legs beneath desktop 21. One having ordinary skill in the art will recognize that panels 23, back 24 and cabinet 40 could elevate desktop 21 to other heights above floor 9, such as a height ergonomically convenient for a user to stand upright or sit at a tall seat (not shown) such as a bar stool and use computer 1, without departing from the spirit and scope of the present invention.

Cabinet 40 substantially bifurcates the space beneath desktop 21 to create two work stations L, R, one each on either side of axis A. Space between cabinet 40 and end panels 23 accommodates the legs of a user (not shown) seated in front of front edge 25 at either or both of work stations L, R. Spanning between panels 23 and sides 42 of cabinet 40 a spaced distance beneath desktop 21 and a convenient height above floor 9, storage shelves 53 preferably extend forward from back 24 equidistant with end panels 23 and serve both to brace and stabilize desk 20 and to provide storage for supplies, equipment and the like. Toe boards 27 may span between panels 23 and sides 42 adjacent floor 9 further to brace and strengthen back 24.

Preferably, between cabinet 40 and side panels 23, front edge 25 follows a substantially uniform curvature the radius of which extends from axis B such that the portions of front edge 25 within work stations L, R is substantially equidistant from monitor 3. Thus, the curvilinear shape of front edge 25 allows the user to sit facing monitor 3 while squarely addressing front edge 25, rather than having to sit at an angle were desktop 21 substantially rectangular. One having ordinary skill in the art will recognize, however, that all desktop 21 shapes and front edge 25 curvatures are considered to be within the spirit and scope of the present invention.

Cabinet 40 preferably opens toward front edge 25 of desk 20 and extends symmetrically about transverse axis A from back edge 26 to near front edge 25. Sides 42 of cabinet 40 are longitudinally spaced apart a convenient distance to allow insertion and storage of computer 1. Deck 45 spans between sides 42 within cabinet 40 to support computer 1 a few inches above floor 9 to isolate computer 1 from dust and the like on floor 9. Disposed a conveniently spaced distance below desktop 21 within cabinet 40, shelf 46 further divides vertically the space within cabinet 40 to create alcove 47 for other equipment or supplies while leaving ample height above deck 45 for computer 1.

As best seen in FIGS. 4 and 5, cabinet 40's interior includes a width and height appropriate for a conventionally encased computer 1 and other similarly sized equipment. Computer cases typically are approximately eight (8") inches wide and approximately twelve to fifteen (12"-15") inches high. Cabinet 40's width minimizes the longitudinal space it occupies beneath desktop 21, thereby maximizing the roominess of workstations L, R while keeping them close enough together to allow convenient access to computer 1. Thus, the space between side panels 42 preferably is at least ten (10") inches wide, while the vertical distance between deck 45 and shelf 46 is approximately twenty-four (24") inches. One having ordinary skill in the art will recognize, of course, that cabinet 40 may comprise other dimensions to accommodate computers 1 having different casings and configurations, without departing from the spirit and scope of the present invention.

Disposed within cabinet 40 atop both deck 45 and shelf 46, sliding trays 44 provide slidable access to computer 1 on deck 45 and accessories or other equipment (not shown) on shelf 46. Trays 44 considerably enhance the convenience of cabinet 40 since its width has been minimized to accommodate with little clearance the width of computer 1. Typically, those connections, buttons, trays and doors on computer 1 which require frequent access by a user are located on its front face 2, but other, relatively fixed connections for leads (not shown) to monitor 3 and other peripheral devices (not shown) are located on the back panel (not shown) of computer 1. By sliding tray 44 on which computer 1 rests, a user may access the back panel (not shown) of computer 1 where most such fixed connections are located. Likewise, tray 44 disposed on shelf 46 provides similar access to any equipment (not shown) or accessories stored within alcove 43.

Disposed below desktop 21 within work stations L, R, sliding controller drawers 51 span between side panels 23 and sides 42 of cabinet 40. Controller drawers 51 are spaced below desktop 21 to an elevation above floor 9 as to be ergonomically appropriate for a user (not shown) seated at desk 20 and yet sufficiently deep to accommodate use of keyboard 5 and mouse 6 stationed thereon. Preferably, controller drawers 51 are approximately eight (8") inches below desktop 21, but one having ordinary skill in the art will recognize that other spaced distances for controller drawers 51 may be appropriate for other, less conventional controller equipment.

Figure 7:
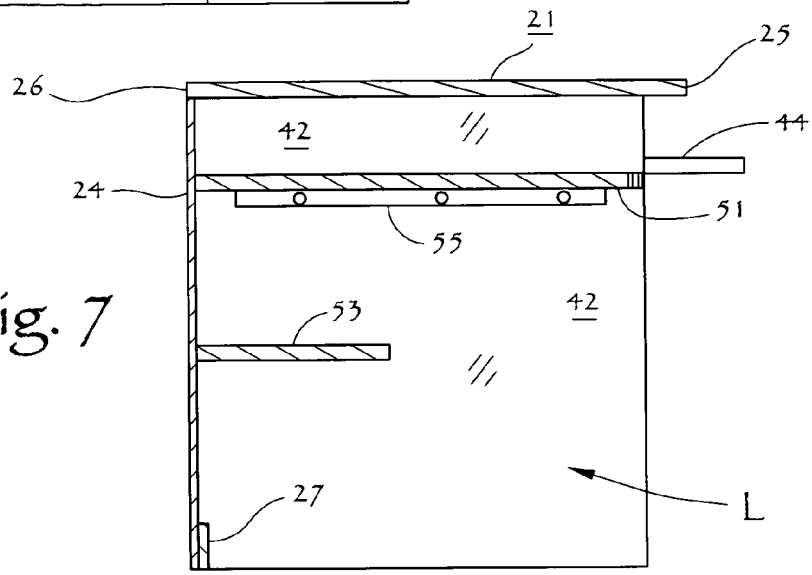
FIG. 7 shows a left side cross sectional elevation of the desk of FIG. 1 as indicated in FIG. 5.

Controller drawers 51 may articulate between their retracted and extended positions on simple ledges (not shown) extending longitudinally from side panels 42 and end panels 23, while trays 44 may slide in full contact with deck 45 and shelf 46, in both cases confined on their top surfaces by a longitudinally extending lug to prevent them from tipping forward. Preferably, however, both controller drawers 51 and trays 44 move on metal, ball bearing roller slides 47, 55 (see FIGS. 7, 8) to smooth their gliding between positions and to retain sufficient strength to support their weight and the weight of equipment and accessories that may be placed upon them. Such roller slide systems preferably are metal strips which attach between the longitudinal edges of trays 44 and drawers 51 and side and end panels 42, 23, but as shown in the figures, they need not be coplanar with drawers 51 and trays 44. A variety of suitable roller slide 47, 55 systems is available from Rockler.com (http://www.rockler.com).

Figure 8:
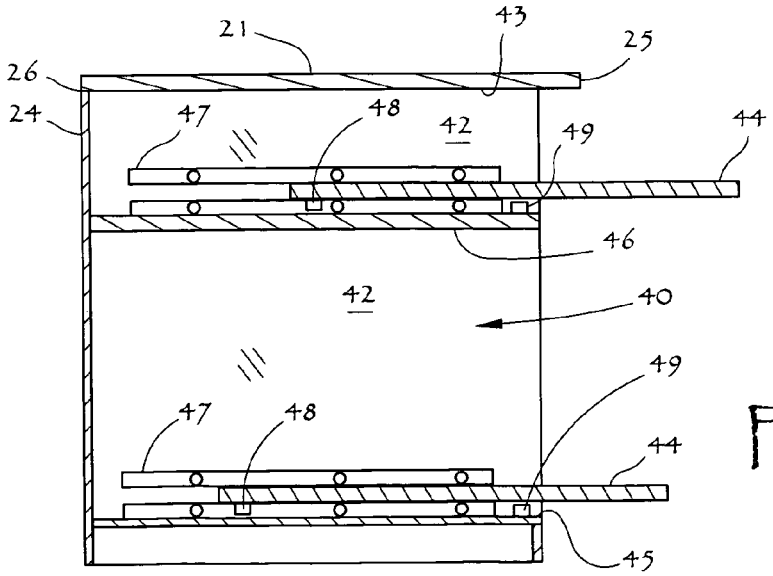
FIG. 8 is a left side cross sectional elevation of the desk of FIG. 1 as indicated in FIG. 5.

A stopping mechanism is required to prevent drawers 51 and trays 44 from being inadvertently extended beyond their supports and retracted too far. Where roller slides 47, 55 do not provide them internally, they must be provided as part of desk 20. One such stopping mechanism is depicted in FIG. 8, where in lugs 48 coupled to the bottom of trays 44 engage stops 49 near the front edges of deck 45 and shelf 46 respectively. Notch 52 in the longitudinal edge of drawers 51 adjacent end panels 23 prevents drawers 51 from retracting so far as to make contact with back 24 and to become retracted so deeply beneath desktop 21 as to be inconvenient to access. Cushioning means, such as a strip of felt (not shown) along the longitudinal length of notch 52 that engages the front edge of panel 23 prevents noise and marring of drawer 51 or side panel 23 from such contact.

Shown disposed above controller drawers 51 in work station R, gaming controller 10 clamps to front edge 25 of desktop 21. Gaming controller 10 comprises a series of devices adapted to be manipulated by a user (not shown) seated at work station R to operate a software program running on computer 1. Such software, in concert with gaming controller 10, simulates a driving experience such as a race car on a motor speedway, highway or the like. As best seen in FIG. 2, keyboard 5 and mouse 6 are set up in workstation L on the opposite side of cabinet 40 from game controller 10. As discussed in more detail below, keyboard 5 and mouse 6 alternatively may be placed onto drawers 51 within workstation R if needed or if more convenient to the user during a gaming session with controller 10.

Gaming controller 10 shown in the figures comprises steering wheel 11 held to desktop 21 by clamping means 13. Clamped to controller 10 within work station R, shift 16 comprises a simulated gear shift of an automobile and must be held stationary for realistic manipulation. Thus, it must be anchored to desk 20 or otherwise stable and disposed within reach of the user. Disposed on floor 9 within work station R, foot pedals 15 further provide the user with software controlling devices to enhance the driving experience. One having ordinary skill in the art will recognize that gaming controller 10 could include alternate devices such as throttle controls, aileron levers or the like (not shown) to simulate, e.g., a flying experience in an airplane, or other control simulations, without departing from the spirit and scope of the present invention.

One having ordinary skill in the art also will recognize that elaborate gaming controller arrangements such as those depicted in the figures require considerable time and effort to set up and dismantle. Yet, because of their volume and configuration, they substantially occupy work station R to the practical exclusion of convenient use of other controllers for computer 1 such as using keyboard 5 and mouse 6 for non-gaming applications. Thus, having both workstations L, R renders far more convenient the use of computer 1 for both gaming and other uses.

Disposed atop desktop 21 substantially centered on axis A, monitor 3 is adapted to articulate between alternate positions in which it faces either of work stations L, R. Though many monitors 3 include bases (not shown) which swivel to make such articulation possible, the present invention includes swivel support or turnstile 30 to provide such convenience also for monitors 3 which either are not so equipped or whose bases (not shown) do not swivel enough. Turnstile 30 comprises lower and upper circular metal plates 33, 34 sandwiching bearings 35 which are confined within grooves 36 around the perimeters of plates 33, 34. Atop upper plate 34, platform 32 supports monitor 3. Exerting turning force about vertical axis B on monitor 3 causes upper plate 34 to rotate about axis B relative to lower plate 33, thus re-orienting monitor 3 to face a different direction. Turnstile 30 preferably is not affixed to desktop 21 but remains free to be displaced about the surface of desktop 21 as desired, and includes non-scratch layer 36 on the bottom of plate 33 to prevent damage to workspace 21 when monitor 3 and turnstile 30 are moved about. One having ordinary skill in the art will recognize that lower plate 33 easily could be affixed to desktop 21 using screws or other fasteners (not shown).

In operation, a user (not shown) places monitor 3 atop turnstile 30 and extends its power and signal cords (not shown) through back 24 using cord aperture 29 into cabinet 40. Tray 44 is fully extended and computer 1 is placed onto it with its front edge near the front of tray 44. Monitor 3 power and signal cords (not shown) then are hooked up appropriately to computer 1. Keyboard 5 and mouse 6 are placed on controller drawers 51 within workstation L, and their leads 7 are extended to computer 1 by routing them through the front of cabinet 40 rather than through cord apertures 28. Tray 44 then is retracted into cabinet 40 by pushing it toward back 24 until computer 1 is entirely within cabinet 40 between side panels 42. A power cord (not shown) for computer 1 also is extended between the back of computer 1, through aperture 29 and to a convenient power outlet (not shown), or to a power strip (not shown) conventionally provided for computer installations. Leads 7 remain extended out the front of cabinet 40, around the front edge of panel 42 and atop controller drawers 51. Though one having ordinary skill in the art will recognize that cord apertures 28 could be used for routing leads 7 as well, the reason for not doing so will become obvious from the discussion below. Monitor 3 is swivelled to face workstation L, and computer 1 is ready for conventional usage with mouse 6 and keyboard 5.

The user (not shown) also will have installed game controller 10 in workstation R as depicted in the drawings and extended its leads 17 through cord apertures 28, 29 as necessary to hook controller 10 to computer 1 and make it operational. When the user wishes to participate in gaming using controller 10, monitor 3 may be swivelled toward controller 10 and keyboard 5 and mouse 6 placed on controller drawer 51 within workstation R (FIG. 1) for ready access should it be needed during gaming. Since the lead wires from keyboard 5 and mouse 6 extend into cabinet 40 from the front, they need not be extracted and re-threaded through cord apertures 28, 29, making shifting them between workstations L and R quite easy. Alternately, keyboard 5 and mouse 6 could be left in place in the opposite workstation L (as in FIG. 2) since they often are not needed during gaming. In any case, the user proceeds to operate controller 10 and, as needed, keyboard 5 and mouse 6 to enjoy gaming activities. When the user alternately wishes to use computer 1 as a business or personal computer instead of a game machine, he more conveniently may do so from workstation L, most likely moving keyboard 5 and mouse 6 back to drawer 51 of workstation L, but not having to remove or uninstall controller 10 to do so.

The present invention, described in either its preferred or alternate embodiment, thus serves as a dual station desk for a computer 1 which may be employed alternately as a gaming machine using controller 10 and as a business or other machine. Workstations L, R are sufficiently close together that a user (not shown) sitting at either easily may reach computer 1, and keyboard 5 and mouse 6 maybe shifted easily from one workstation L or R to the other. Monitor 3 easily may be swivelled on turnstile 30 to face either workstation L, R without having to be lifted and moved. Work surface 21 is amply large to lay books, papers or the like (not shown) atop desk 20 while computer 1 is used as a business machine, or to provide operations manuals, notes or the like (not shown) while computer 1 is used as a game machine. Work stations L, R are sufficiently roomy for a user's legs, and controller drawers 51 may be extended outward to expose keyboard 5 and mouse 6 for easy access.

While the invention has been particularly shown and described with reference to one or more embodiments, it will be understood by those skilled in the art that various changes in form and detail may be made therein without departing from the spirit and scope of the invention. For example, work surface 21 is depicted in the drawings as planar and substantially semicircular, but it could be shaped otherwise, such as rectangular and/or multilevel, including provision of a hutch (not shown) spanning across monitor 3 between end panels 23. Also, end panels 23 themselves could provide upright support for such a hutch, making it part of desk 20. Monitor support 30 is depicted as a turnstile resting upon desktop 21, but it could comprise a stand alone support mounted to a wall or on a floor stand (neither shown) positioned behind back 24.

We claim:

1. A dual-use computer desk adapted to rest upon a platform or floor and comprising:

a planar work surface elevated above the floor, the work surface having a longitudinal length bifurcated by a transverse axis; and front and back edges along the longitudinal length;

a back disposed between the back edge and the floor;

end panels disposed near opposite ends of the back, wherein the work surface, back, end panels and floor define a recess;

a cabinet extending along the transverse axis to the front edge and dividing the recess into two user work stations, each of the work stations being disposed on opposite sides of the cabinet within the recess and extending from the back to the front edge, thereby being adapted to receive beneath the work surface and on opposite sides of the cabinet the feet and legs of two users seated at the front edge, the users facing radially inward towards the transverse axis and separated by the cabinet;

two adjustable drawers, one each disposed within each of the work stations a spaced distance beneath the work surface and adapted to articulate parallel to the transverse axis between a retracted position substantially beneath the work surface and an extended position; and monitor positioning means disposed on the work surface for positioning a computer monitor resting thereupon facing radially toward any one of a plurality of directions between and including each of the work stations.

2. The dual use computer desk according to claim 1 wherein the cabinet further comprises:

cabinet sides extending vertically parallel to the end panels and in a straight line from the work surface to the floor, the cabinet sides, back, work surface and floor defining an enclosure adapted to surround and enclose a computer;

a deck disposed within the enclosure and adapted to support the computer; and storage means disposed within the recess for storing computer accessories.

3. The dual use computer desk according to claim 2 and further comprising a first slidable tray disposed on the deck and adapted to support the computer and to slide parallel the transverse axis.

4. The dual use computer desk according to claim 3 wherein the storage means comprises a shelf disposed between the cabinet sides beneath the work surface above the computer; and a second slideable tray disposed on the shelf.

5. The dual use computer desk according to claim 4 wherein the storage means further comprises two storage shelves, one disposed within each user work station below the drawers and spanning between an end panel and one of the cabinet sides.

6. The dual use computer desk according to claim 2 wherein the storage means comprises:

two storage shelves, one of the storage shelves disposed within each user work station below the drawers and spanning between an end panel and one of the cabinet sides;

a shelf disposed between the cabinet sides beneath the work surface and defining an alcove; and a slideable tray disposed on the shelf.

7. The dual use computer desk according to claim 1 wherein the monitor positioning means comprises a monitor turnstile having:

an upper plate and a coaxial lower plate, each plate having annular, substantially hemispheric grooves adapted to receive a portion of a ball bearing;

a plurality of ball bearings disposed within the annular grooves to hold the plates apart a spaced distance and to permit them to rotate smoothly relative to each other about a vertical axis;

cushioning means disposed on the lower circular plate opposite the upper plate;

a platform disposed on the upper plate opposite the lower plate and adapted to support the computer monitor; and support means for supporting the computer monitor at substantially eye level to the user of the computer desk.

8. The dual use computer desk according to claim 1 wherein;

the cabinet extends along the transverse axis a distance at least twice as far from the back as do the end panels; and the front edge follows a curvilinear path between the end panels and a front of the cabinet that is substantially equidistant from the monitor positioning means.

9. The dual use computer desk according to claim 1 wherein each of the drawers further comprises stop means for limiting its travel in the direction of the retracted position.

10. The dual use computer desk according to claim 9 wherein the stop means comprises a notch disposed within a side edge of the drawer and adapted to engage a front edge of the end panel.

11. The dual use computer desk according to claim 1 and further comprises:

a first side edge disposed on each of the drawers adjacent and substantially parallel an end panel;

a second side edge disposed on each of the drawers opposite the side edge and adjacent and substantially parallel the cabinet;

a first roller slide means disposed on each drawer and coupled between its first side edge and the end panel; and a second roller slide means disposed on each drawer and coupled between its second side edge and the cabinet.

12. A dual-use computer desk comprising:

a planar work surface having a longitudinal length bifurcated by a transverse axis;

front and back edges along the longitudinal length;

a back disposed below the back edge and extending fro the work surface to a floor;

end panels disposed parallel to the transverse axis on opposite ends of the back beneath the work surface, wherein the work surface, back, end panels and floor define a desk interior;

a cabinet disposed astraddle the transverse axis within and bifurcating the interior into two user work stations, each work station disposed on one side of the cabinet opposite the other work station and adapted to accommodate simultaneously two users facing radially inward toward a computer monitor disposed atop the transverse axis near the back edge, the cabinet having substantially vertical sides extending a straight line from the work surface to the floor, the vertical sides, back, work surface and floor defining a computer chamber adapted to surround and contain a computer;

a sliding tray disposed within the computer chamber and adapted to support the computer and to extend parallel the transverse axis to provide access to the computer; and storage means disposed within the computer chamber above the sliding tray for storing computer accessories;

two adjustable keyboard drawers disposed on opposite sides of the cabinet within the work station, each drawer having drawer side edges extending parallel the transverse axis;

roller slide means coupled between the drawer side edges and the cabinet and the end panels; and a notch disposed within a drawer side edge and adapted to engage a front edge of an adjacent end panel to limit the travel of the keyboard drawer; and a turnstile disposed on the work surface and adapted to rotate about a vertical axis to hold the computer monitor in a plurality of angular positions facing the users, the turnstile having an upper plate and a coaxial lower plate, each plate having annular, substantially hemispheric grooves adapted to receive a portion of a ball bearing;

a plurality of ball bearings disposed within the annular grooves to hold the plates apart a spaced distance and to permit them to rotate smoothly relative to each other about a vertical axis;

cushioning means disposed on the lower plate opposite the upper plate; and a platform disposed between the upper plate and the computer monitor.

13. An improved method of utilizing a computer for both playing computer games and other computer activities, said computer games and computer activities comprising software executable on a computer and controlled by user input devices, including a keyboard, mouse and game controllers adapted realistically to simulate driving a vehicle, the method comprising providing a computer desk having a planar work surface having a transverse axis bifurcating a longitudinal length and elevated above a support platform by end panels disposed opposite each other equidistant from the transverse axis and a back extending between the end panels, wherein the work surface, back, platform and end panels define a desk interior;

a cabinet symmetric about the transverse axis and extending between the work surface and the platform to divide the desk interior into first and second work stations disposed on opposite sides of the transverse axis below the work surface and adapted to accommodate two users simultaneously manipulating one of the user input devices;

stationing means for installing the user input devices; then installing the computer within the cabinet;

installing the keyboard and mouse within the first work station and electrically coupled to the computer;

installing a game controller within the second work station and electrically coupled to the computer; then manipulating the user input devices to operate software from either work station.

14. The improved method of claim 13 wherein the stationing means comprises slidable controller drawers disposed within each workstation.

15. The improved method of claim 13 and further comprising a sliding tray disposed on a deck within the cabinet and adapted to slidably support a computer.

16. The improved method of claim 13 wherein the manipulating step comprises operating the keyboard and mouse to control said computer activities.

17. The improved method of claim 13 wherein the manipulating step comprises operating the game controller to play a computer game from the second work station.

18. The improved method of claim 13 wherein the manipulating step comprises operating the game controller and the keyboard and mouse to play a computer game from the second work station.

* * * * *